US007472982B2

(12) United States Patent
Chen

(10) Patent No.: US 7,472,982 B2
(45) Date of Patent: Jan. 6, 2009

(54) INK REMOVAL DEVICE

(75) Inventor: Chih-Hung Chen, Tainan (TW)

(73) Assignee: Qisda Corporation, Taoyuan County (TW)

( * ) Notice: Subject to any disclaimer, the term of this patent is extended or adjusted under 35 U.S.C. 154(b) by 238 days.

(21) Appl. No.: 11/000,043

(22) Filed: Dec. 1, 2004

(65) Prior Publication Data

US 2005/0134635 A1 Jun. 23, 2005

(30) Foreign Application Priority Data

Dec. 5, 2003 (TW) ..... 92221430 U

(51) Int. Cl.
*B41J 2/165* (2006.01)
*B41F 35/00* (2006.01)
*B41F 9/00* (2006.01)

(52) U.S. Cl. ..... 347/33; 400/702; 101/154

(58) Field of Classification Search ..... 347/33; 400/702; 101/154
See application file for complete search history.

(56) References Cited

U.S. PATENT DOCUMENTS 5,455,609 A * 10/1995 Gast et al. ..... 347/32
5,896,145 A * 4/1999 Osborne et al. ..... 347/33
5,905,514 A * 5/1999 Rhoads et al. ..... 347/33
6,189,999 B1 2/2001 Pham et al.
6,412,906 B1 * 7/2002 Lin ..... 347/33
6,601,943 B2 * 8/2003 Barinaga ..... 347/33
2002/0080209 A1 * 6/2002 Lin ..... 347/33
2002/0101462 A1 * 8/2002 Therien ..... 347/1
2002/0122092 A1 * 9/2002 Okamura et al. ..... 347/33

* cited by examiner

*Primary Examiner*—Stephen D Meier
*Assistant Examiner*—Sarah Al-Hashimi

(57) ABSTRACT

An ink removal device for an inkjet printer with a cartridge carrier and a print head. The ink removal device comprises a base, a wiper holder, a rotating member and a scraper. The wiper holder is movably disposed on the base and comprises a wiper disposed thereon to remove residual ink from the print head. The rotating member is disposed on the base. The scraper is rotatably disposed on the rotating member and rotates between a first position and a second position to remove residual ink from the wiper. The wiper moves relative to the scraper by means of the wiper holder sliding on the base.

14 Claims, 21 Drawing Sheets

INK REMOVAL DEVICE

BACKGROUND

The present invention relates to an ink removal device, and in particular to an ink removal device that removes residual ink from a wiper thereof.

Residual ink accumulated on an inkjet printer becomes dense or hardens after long term use, adversely affecting mechanical, operation of the inkjet printer.

Thus, residual ink on a print head of the inkjet printer is typically removed by a conventional ink removal device. The ink removal device generally comprises a wiper for removing residual ink from the print head.

Nevertheless, some ink may remain on the wiper and harden after long-term operation, deteriorating removal performance thereof. Accordingly, an ink removal structure is required for removing the ink from the wiper.

Referring to FIG. 1A, a conventional inkjet printer 1 comprises a cartridge 11, a cartridge carrier 12, a driving means 13 and a maintenance portion 14. A print head P formed with multiple ink nozzles (not shown) is deployed on the bottom of the cartridge 11. As shown in FIG. 1B, an ink removal device 15 comprising a scraper 16 and a wiper 17 can be disposed in the maintenance portion 14. The scraper 16 is fixed in the ink removal device 15. The wiper 17 can reciprocate in a direction shown by arrow A. When the inkjet printer 1 performs maintenance, the cartridge carrier 12 moves onto the maintenance portion 14. The wiper 17 of the ink removal device 15 then reciprocates to clean the print head P (or ink nozzles) of the cartridge 11, as shown in FIG. 1B and FIG. 1C. Operation of the scraper 16 and wiper 17 is described in the following. The scraper 16 is hard plastic or metal and the wiper 17 is rubber. As shown in FIG. 1D and FIG. 1E, the wiper 17 deforms elastically due to obstruction of the scraper 16. Residual ink on the wiper 17 can thus be removed by rubbing the scraper 16.

The ink removal device 15, however, has the following drawback. Since the wiper 17 reciprocating to clean the scraper 16 requires large power, an additional driving means must be disposed in the inkjet printer 1 to drive the wiper 17. The driving means may comprise a motor and transmission mechanism, thus complicating the structure and assembly of the inkjet printer 1 and increasing manufacturing cost thereof.

U.S. Pat. No. 6,412,906 discloses another ink removal device 2 comprising a wiper 21 and a scraper 22, as shown in FIG. 2A. The wiper 21 is fixed on the ink removal device 2 and the scraper 22 is rotatably disposed thereon. The scraper 22 can rotate in a direction shown by arrow B. As shown in FIG. 2A, when the ink removal device 2 moves in a direction shown by arrow C, the wiper 21 removes residual ink from a print head 23. As shown in FIGS. 2B, 2C and 2D, the ink removal device 2 continues to move in the direction shown by arrow C. When encountering a wall 24 of a maintenance portion, the scraper 22 rotates in a direction shown by arrow D around a rotating shaft 25. Since the wiper 21 is rubber, the wiper 21 deforms due to rotation of the scraper 22 and the residual ink thereon can thereby be removed. As shown in FIG. 2E, the ink removal device 2 then moves in a direction shown by arrow E to allow the wiper 21 to wipe the print head 23. Similarly, as shown in FIGS. 2F, 2G and 2H, the ink removal device 2 continues to move in the direction shown by arrow E. When again encountering the wall 24 of the maintenance portion, the scraper 22 rotates in a direction shown by arrow F around the rotating shaft 25. At this point, the wiper 21 again deforms due to rotation of the scraper 22 and the residual ink thereon can be removed.

The ink removal device 2, however, has a drawback as follows. A loud impact noise is created whenever the scraper 22 encounters the wall 24 of the maintenance portion. Additionally, the scraper 22 is easily stuck by the wiper 21.

SUMMARY

Hence, there is a need to provide an improved ink removal device to overcome the aforementioned problems. The present ink removal device operates with reduced power or by a driving means originally existing in an inkjet printer for removing the residual ink from a wiper thereof.

Accordingly, the invention provides an ink removal device for an inkjet printer with a cartridge carrier and a print head. The ink removal device comprises a base, a wiper holder, a rotating member and a scraper. The wiper holder is movably disposed on the base and comprises a wiper disposed thereon to remove residual ink from the print head. The rotating member is disposed on the base. The scraper is rotatably disposed on the rotating member and rotates between a first position and a second position to remove residual ink from the wiper. The wiper moves relative to the scraper by means of the wiper holder sliding on the base.

The ink removal device further comprises a positioning column disposed on the base and comprising a positioning portion to engage and position the cartridge carrier.

The rotating member further comprises a first retardant portion and a second retardant portion. The scraper rotates between the first retardant portion and the second retardant portion.

The scraper abuts the first retardant portion when in the first position, and the scraper abuts the second retardant portion when in the second position.

The ink removal device further comprises a torsion spring disposed between the rotating member and the scraper. The wiper can be rubber and the scraper can be plastic or metal.

Further scope of the applicability of the present invention will become apparent from the detailed description given hereinafter. However, it should be understood that the detailed description and specific examples, while indicating preferred embodiments or the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

Figure 1A:
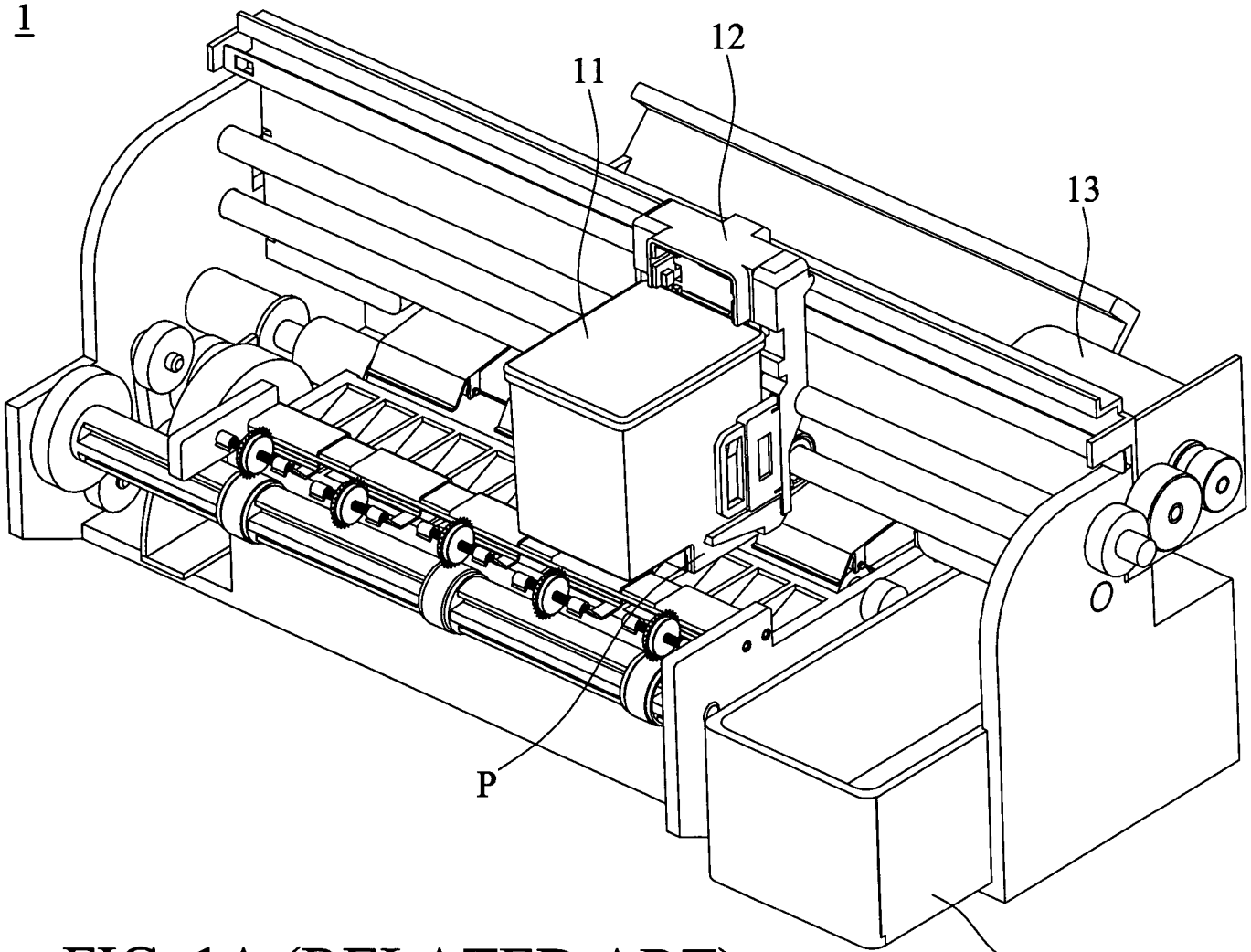
FIG. 1A (RELATED ART)
FIG. 1A is a schematic perspective view of a conventional inkjet printer.
Figure 1B:
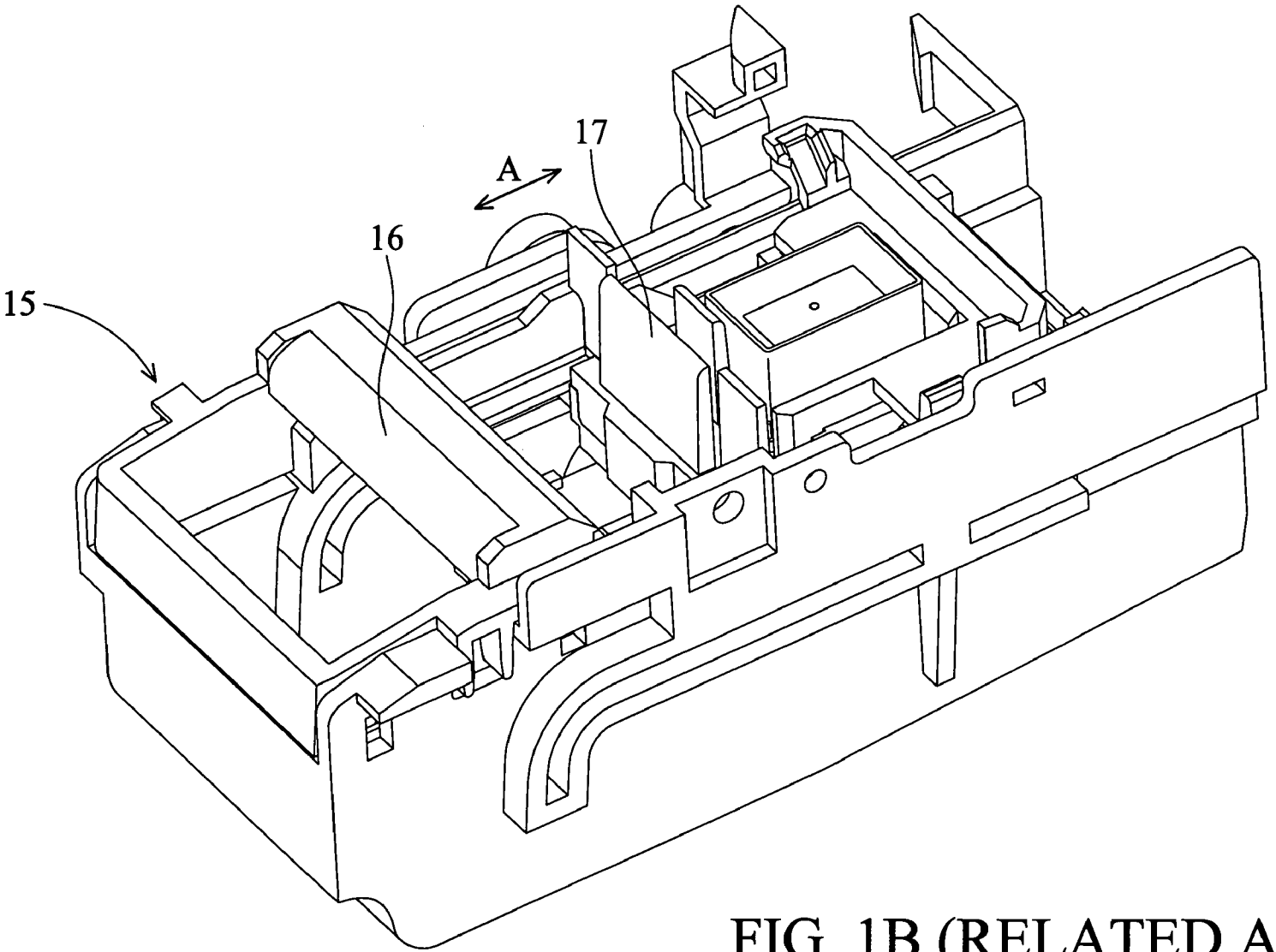
FIG. 1B (RELATED ART)
FIG. 1B is a schematic view showing operation of a conventional ink removal device.
Figure 1C:
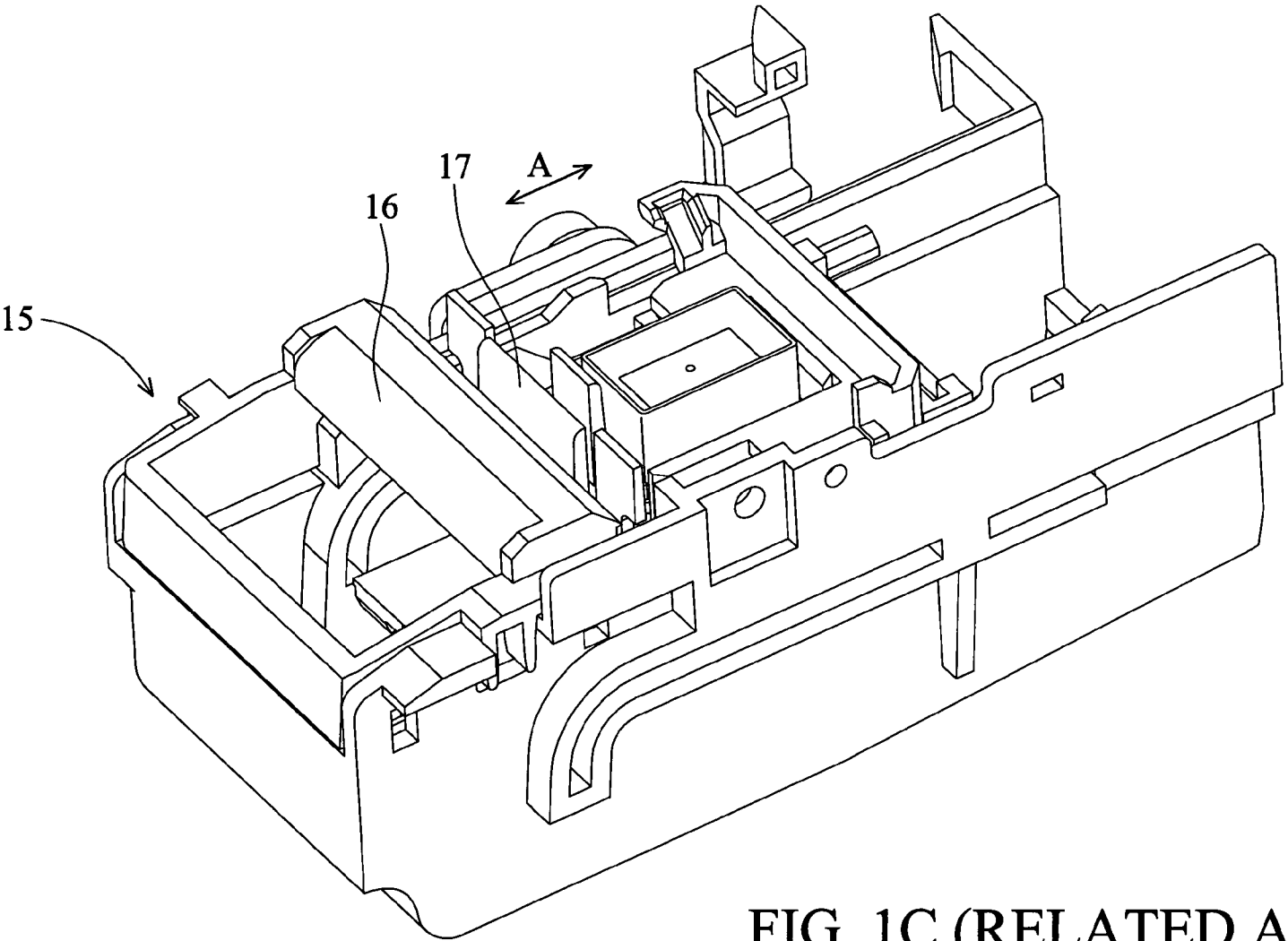
FIG. 1C (RELATED ART)
FIG. 1C is a schematic view showing operation of a conventional ink removal device.
Figure 1E:
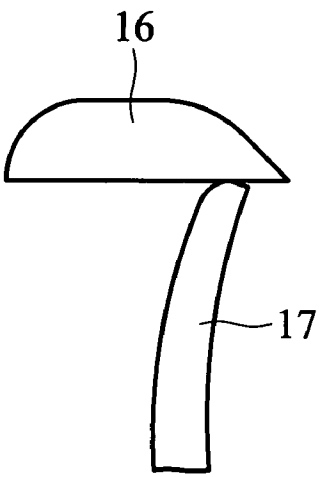
FIG. 1E (RELATED ART)
FIG. 1E is another schematic view showing partial operation of the conventional ink removal device of FIG. 1B and FIG. 1C.
Figure 1D:
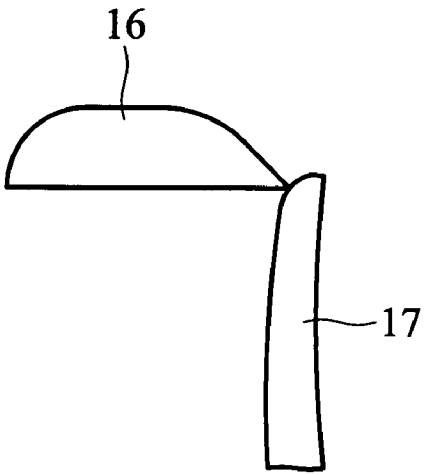
FIG. 1D (RELATED ART)
FIG. 1D is a schematic view showing partial operation of the conventional ink removal device of FIG. 1B and FIG. 1C.
Figure 2B:
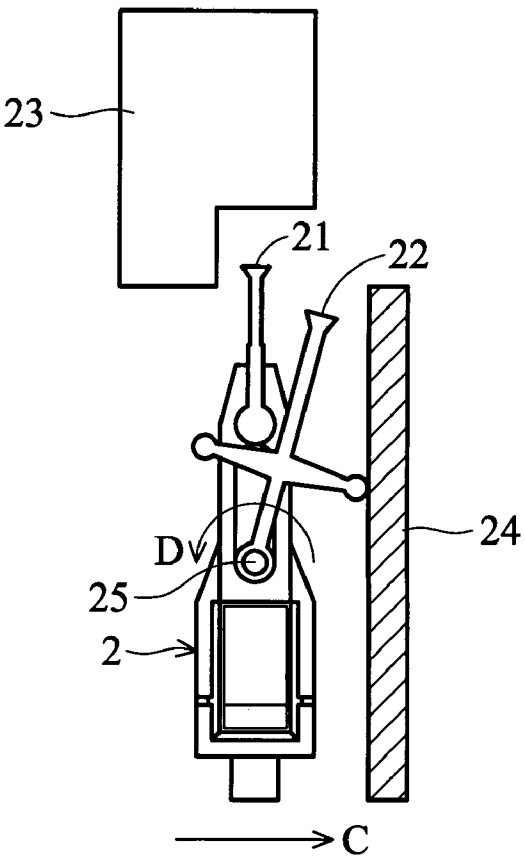
FIG. 2B (RELATED ART)
FIG. 2B is a schematic view showing operation according to FIG. 2A.
Figure 2A:
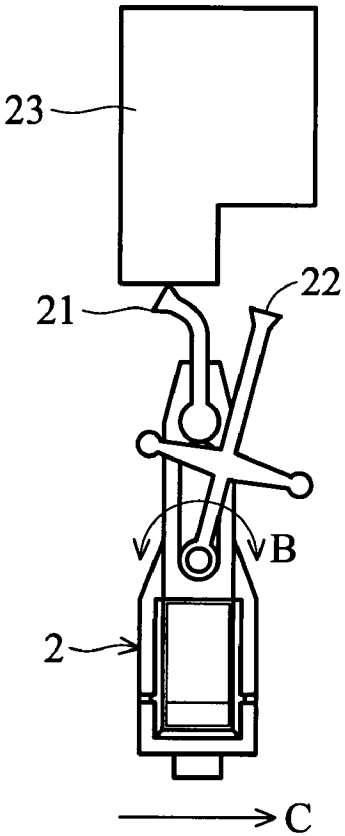
FIG. 2A (RELATED ART)
FIG. 2A is a schematic view showing operation of another conventional ink removal device.
Figure 2D:
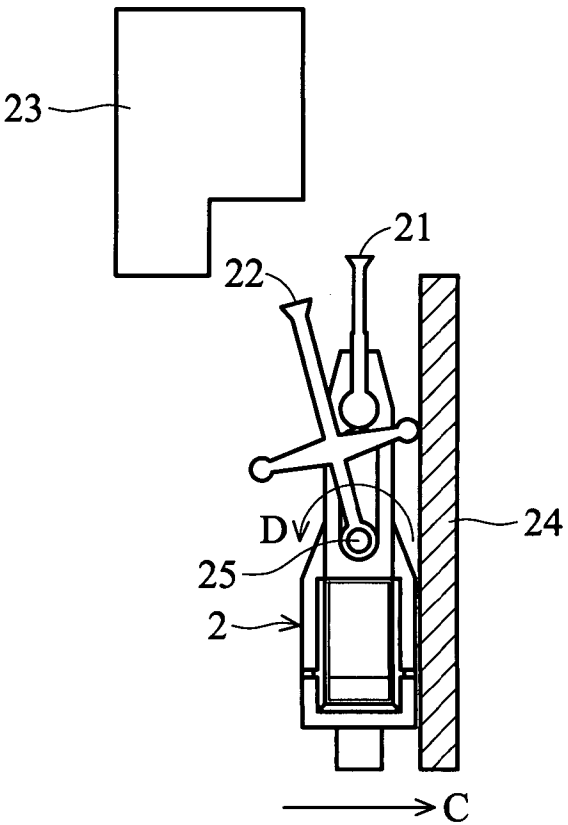
FIG. 2D (RELATED ART)
FIG. 2D is a schematic view showing operation according to FIG. 2C.
Figure 2C:
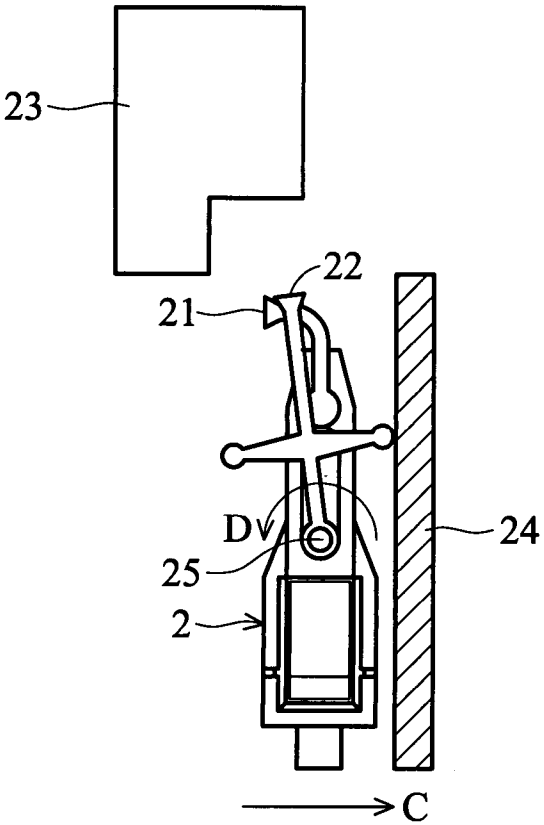
FIG. 2C (RELATED ART)
FIG. 2C is a schematic view showing operation according to FIG. 2B.
Figure 2F:
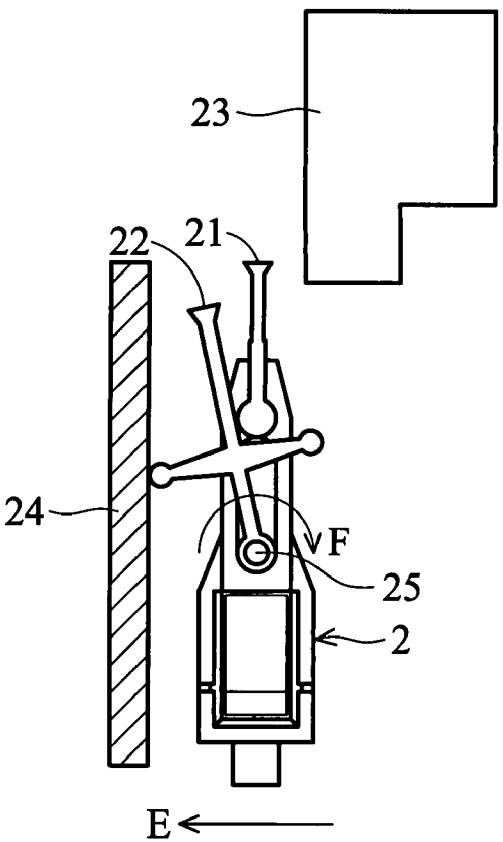
FIG. 2F (RELATED ART)
FIG. 2F is a schematic view showing operation according to FIG. 2E.
Figure 2E:
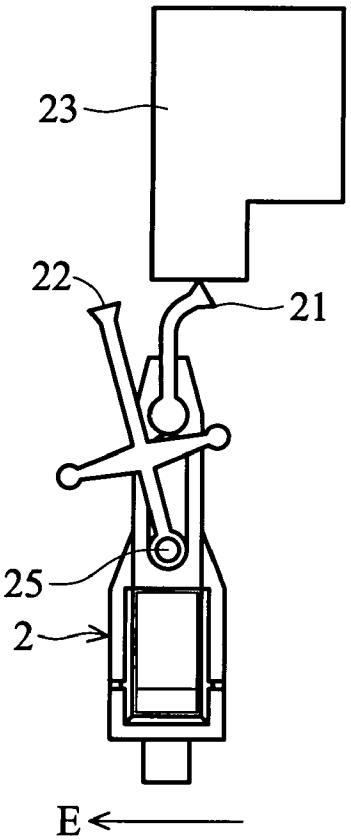
FIG. 2E (RELATED ART)
FIG. 2E is a schematic view showing operation according to FIG. 2D.
Figure 2H:
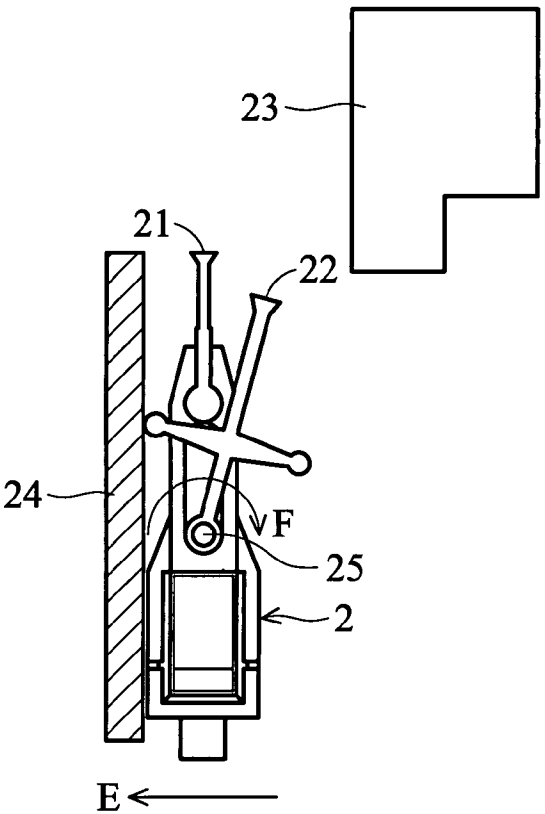
FIG. 2H (RELATED ART)
FIG. 2H is a schematic view showing operation according to FIG. 2G.
Figure 2G:
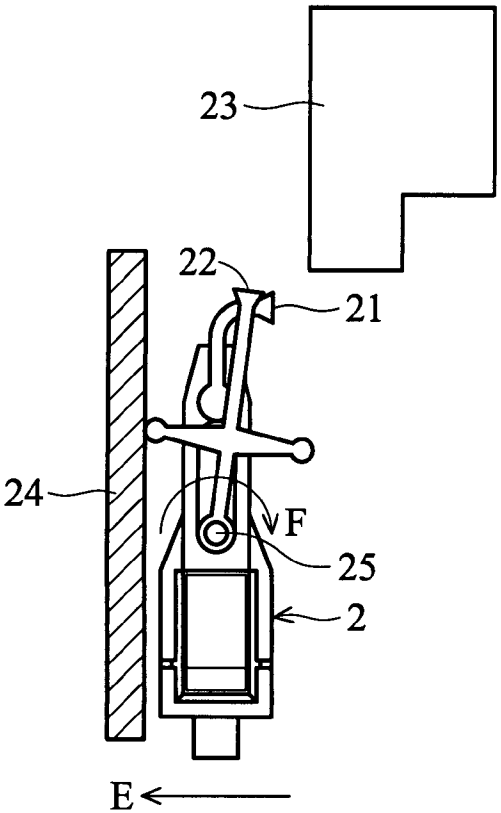
FIG. 2G (RELATED ART)
FIG. 2G is a schematic view showing operation according to FIG. 2F.
Figure 3:
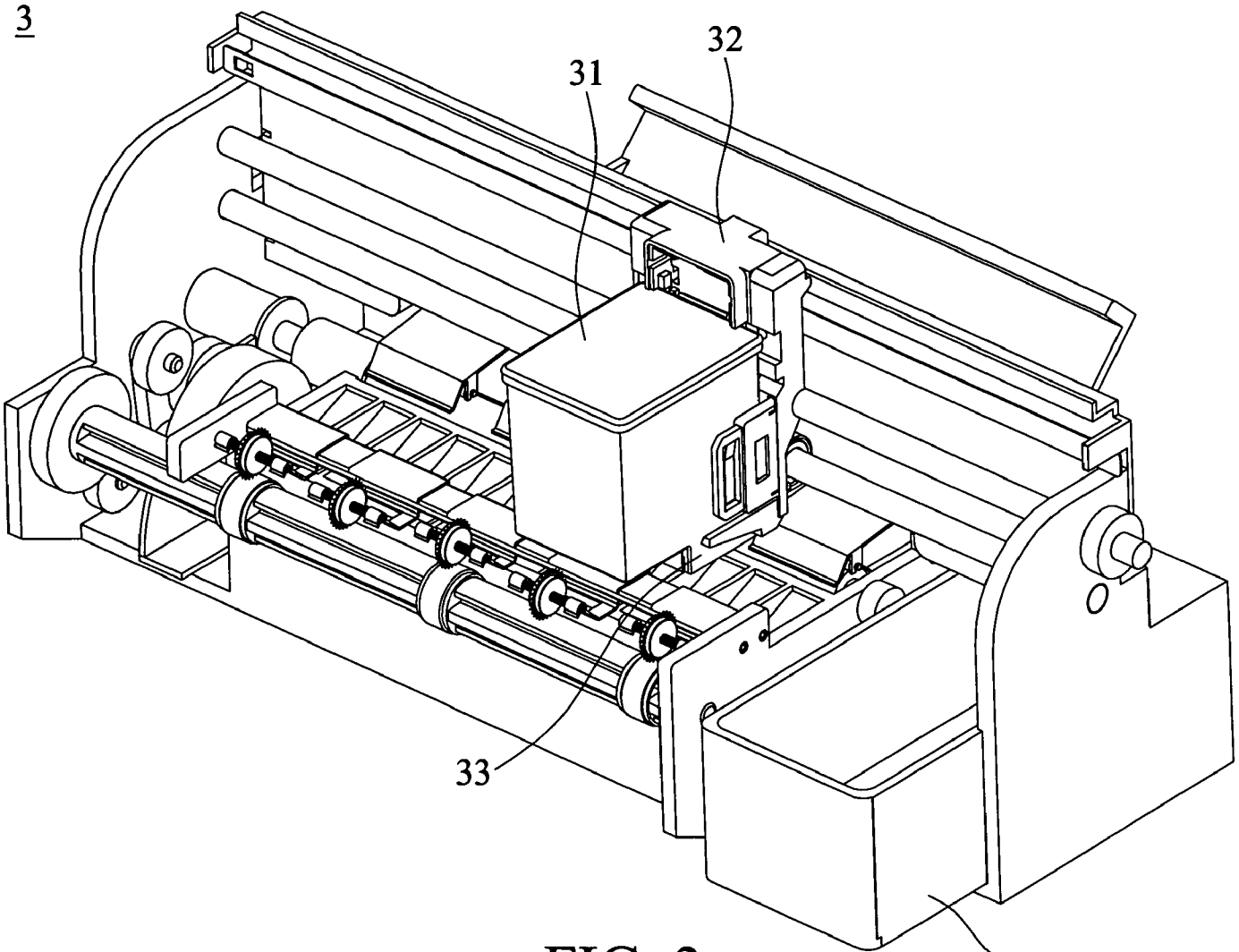
FIG. 3 is a schematic perspective view of an ink-jet printer employing the ink removal device of the invention.
Figure 4A:
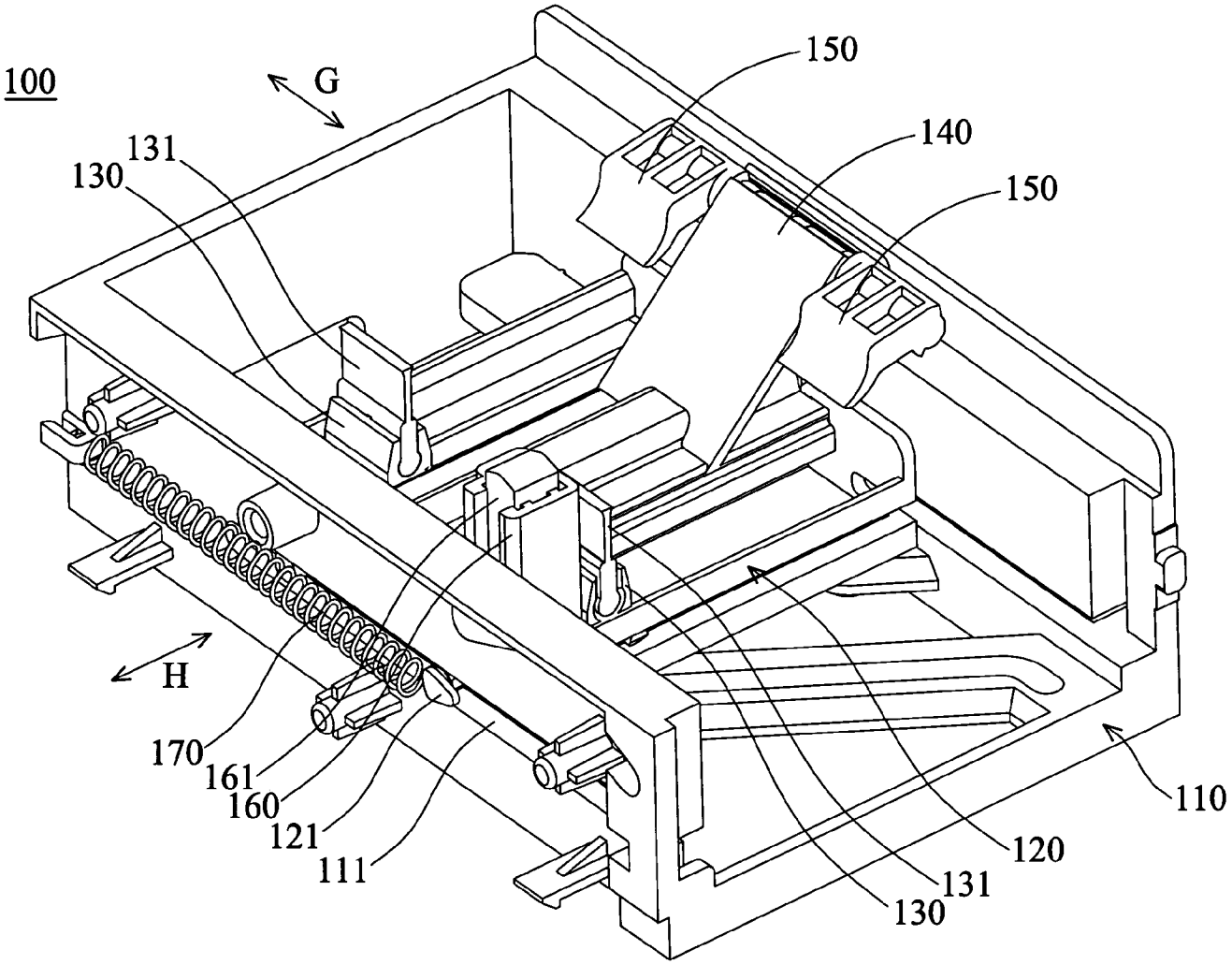
FIG. 4A is a schematic perspective view of the ink removal device of the invention.
Figure 4B:
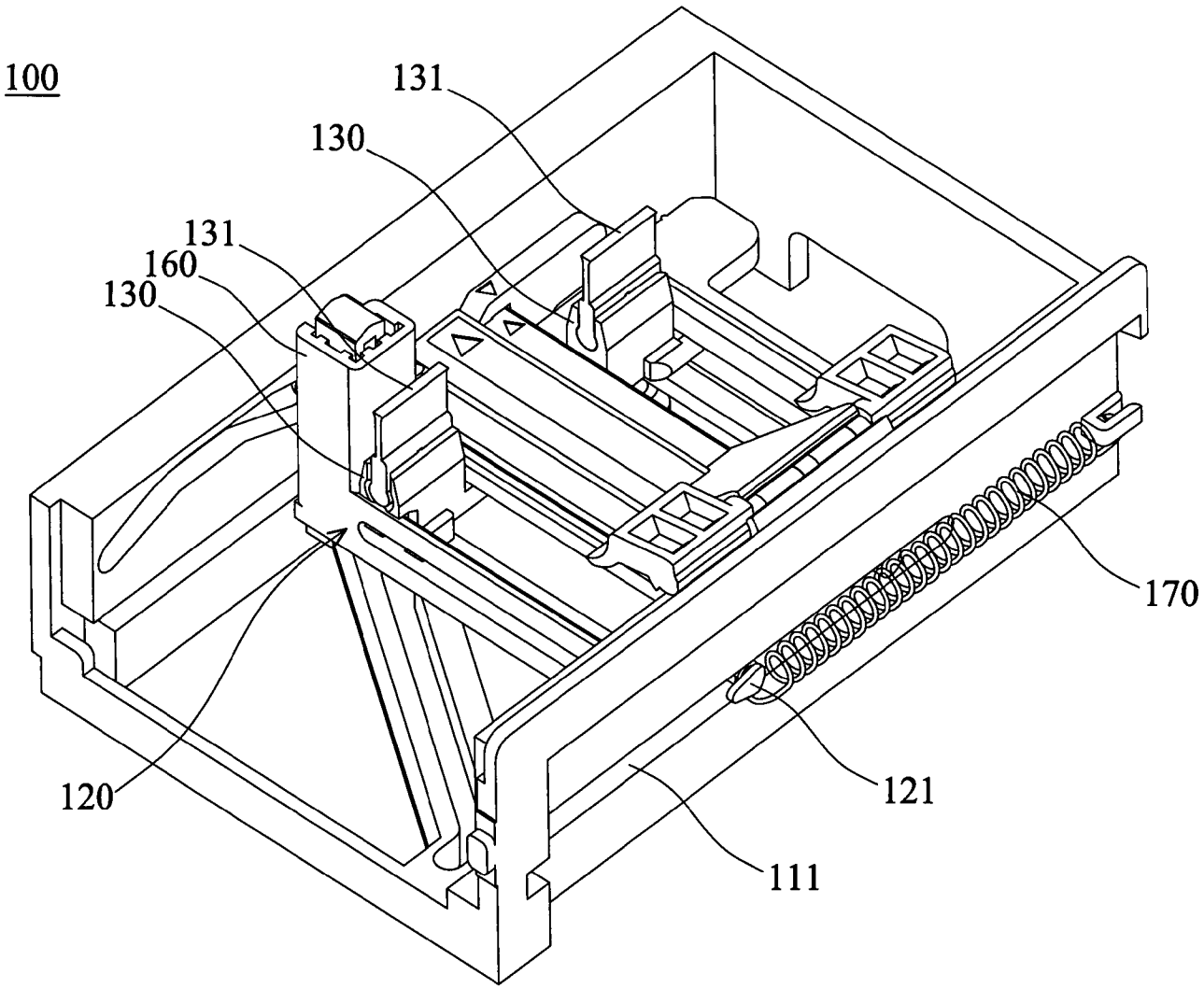
FIG. 4B is another schematic perspective view of the ink removal device of the invention.

Referring to FIGS. 3, 4A and 4B, the ink removal device 100 is employed in an inkjet printer 3 comprising a cartridge 31, a cartridge carrier 32, a print head 33 and a maintenance portion 34. The ink removal device 100 is disposed in the maintenance portion 34.

As shown in FIG. 4A and FIG. 4B, the ink removal device 100 comprises a support structure 110, a base 120, two wiper holders 130, a rotating member 140, two scrapers 150 and a positioning column 160. FIG. 3 and FIG. 4A are from the same angle of view. The angle of view of FIG. 4A is different from that of FIG. 4B by 120°.

Figure 5A:
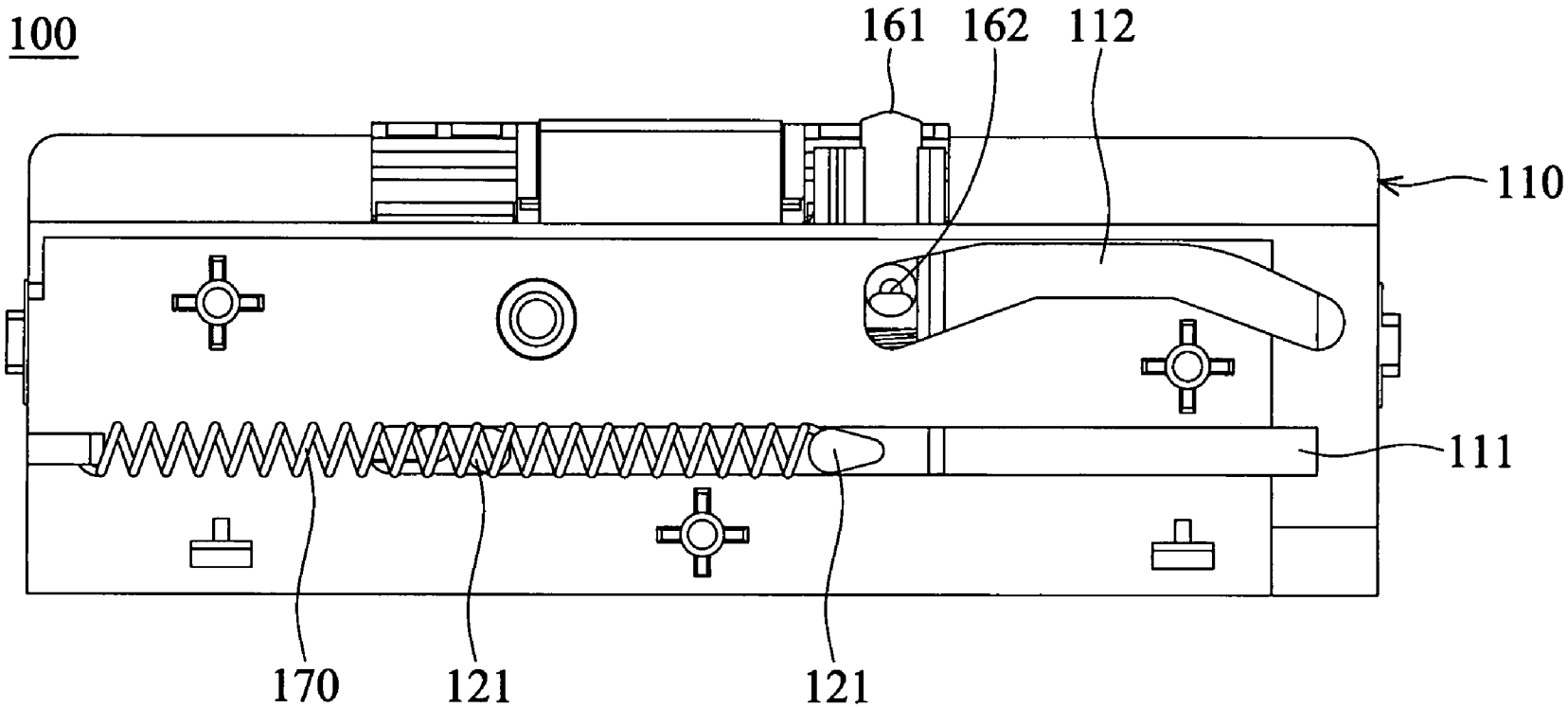
FIG. 5A is a schematic side view according to FIG. 4A.
Figure 5B:
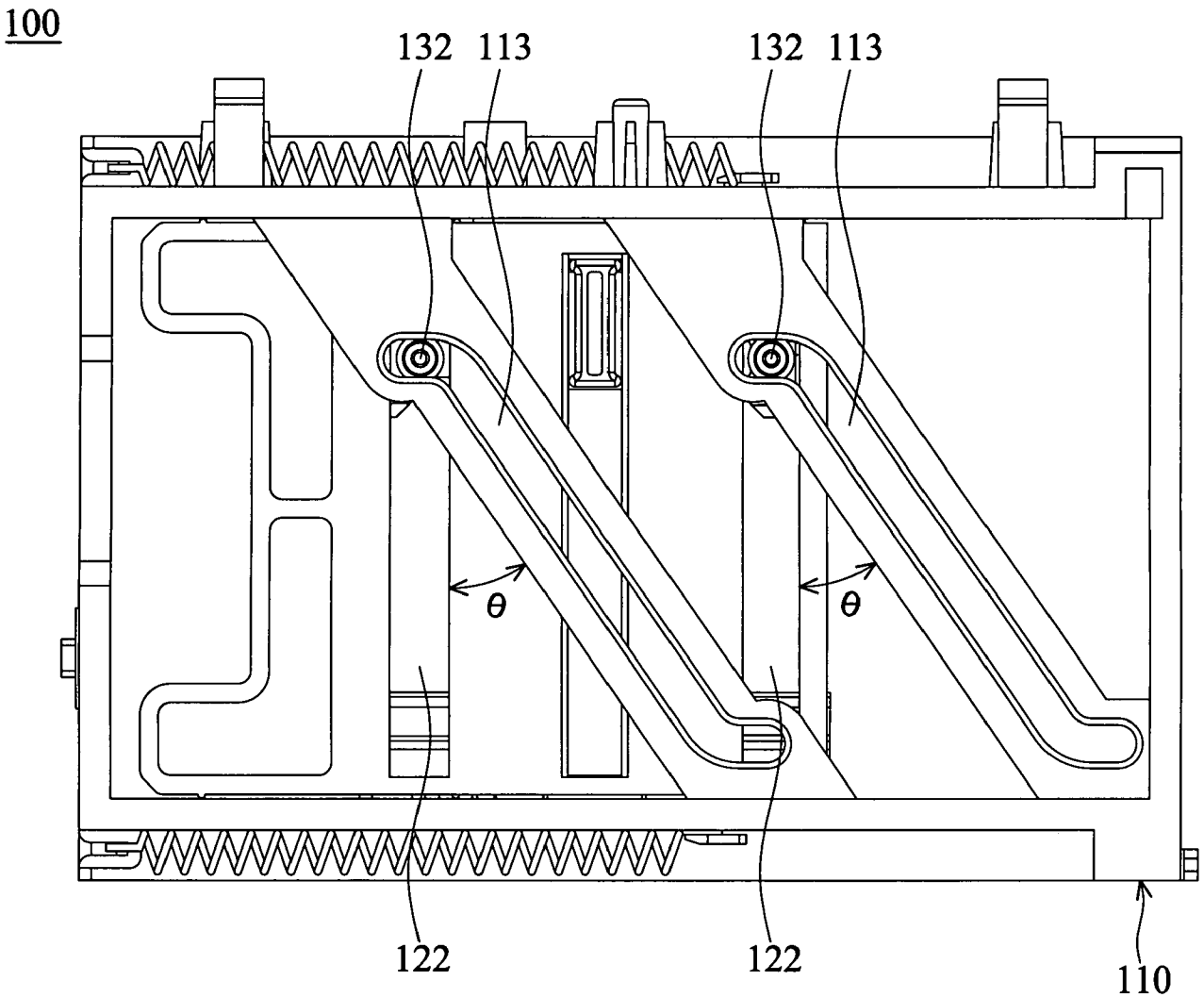
FIG. 5B is a schematic bottom view according to FIG. 4A.

Referring to FIG. 5A and FIG. 5B, two first through grooves 111 are respectively formed on two sides of the support structure 110 and a third through groove 112 is formed on one side thereof. The third through groove 112 is substantially curved. Two parallel fourth through grooves 113 are formed on the bottom of the support structure 110.

Figure 6A:
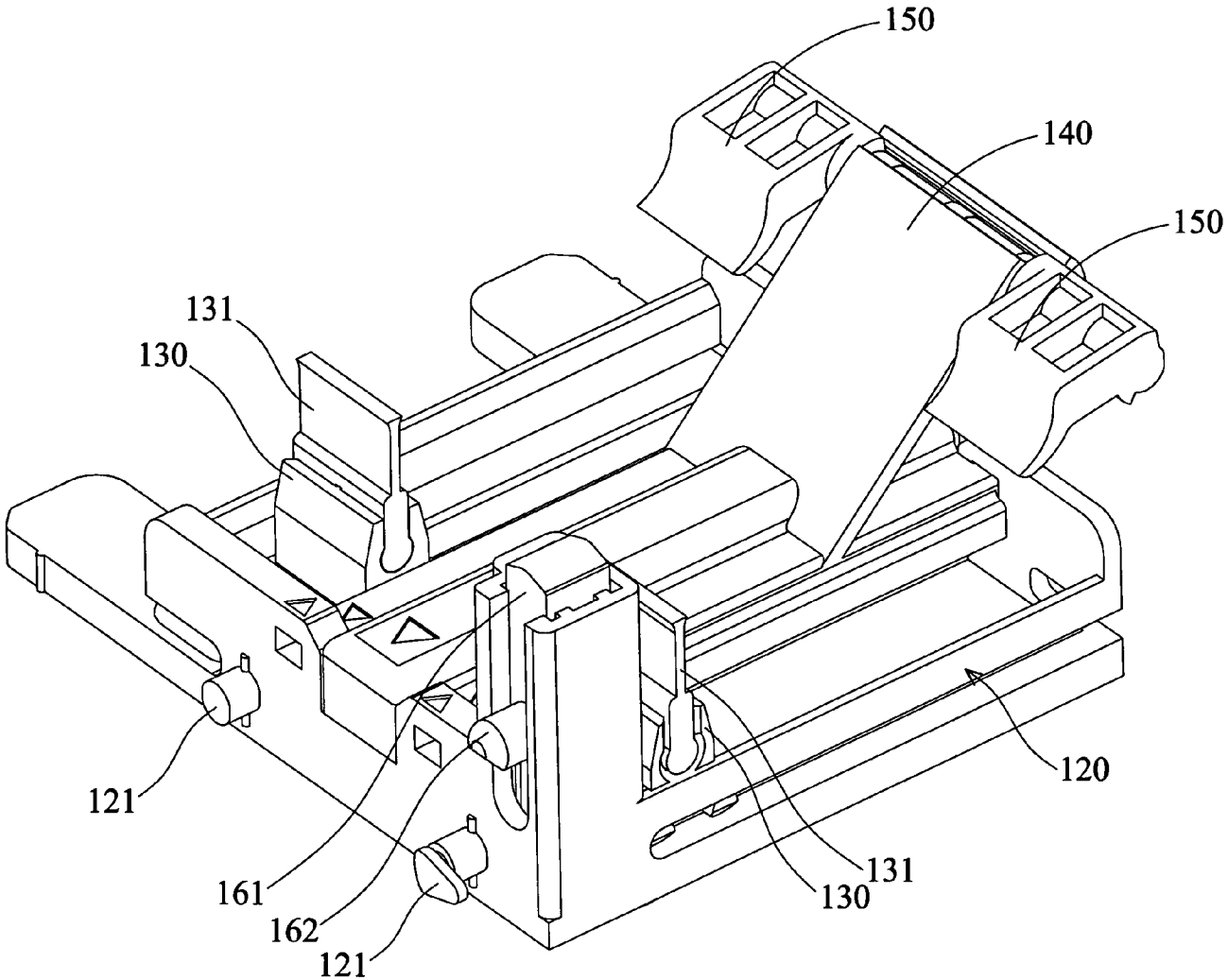
FIG. 6A is a schematic perspective view of the base of the ink removal device of the invention.
Figure 6C:
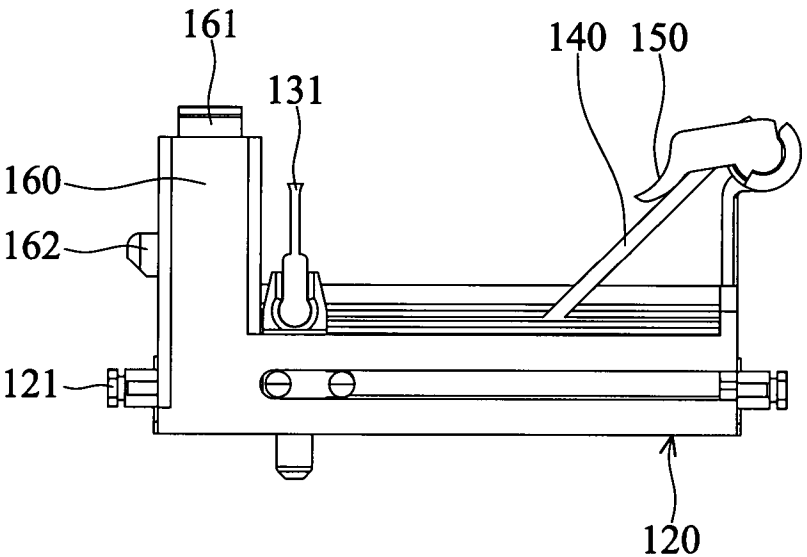
FIG. 6C is a schematic side view according to FIG. 6A.
Figure 6B:
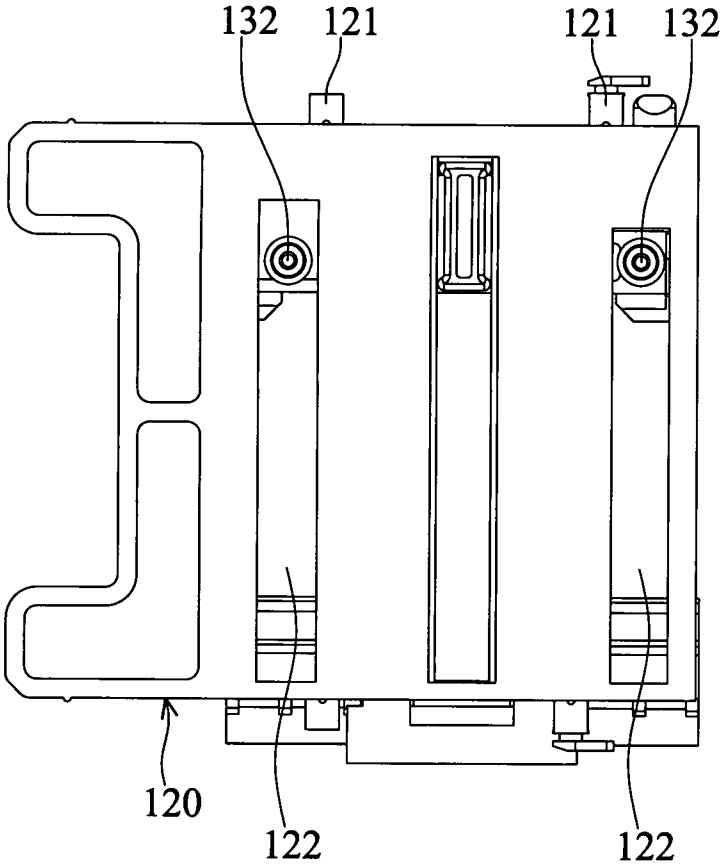
FIG. 6B is a schematic bottom view according to FIG. 6A.

Referring to FIGS. 6A, 6B and 6C, the base 120 is movably disposed on the support structure 110. Specifically, the base 120 can move on the support structure 110 in a direction shown by arrow G, as shown in FIG. 4A. FIG. 4A and FIG. 6A are from the same angle of view. The base 120 comprises two first sliding portions 121 and two parallel second through grooves 122. As shown in FIG. 5A, the first sliding portions 121 respectively slide in the first through grooves 111 of the support structure 110. Specifically, as shown in FIG. 5B, each fourth through groove 113 is below each second through groove 122 and a horizontal included angle θ exists therebetween.

Additionally, the wiper holders 130 are movably disposed on the base 120. Namely, the wiper holders 130 can move simultaneously on the base 120 in a direction shown by arrow H, as shown in FIG. 4A. Specifically, the direction of movement of the wiper holders 130 is perpendicular to that of the base 120. Namely, the direction shown by arrow H is perpendicular to that shown by arrow G. Each wiper holder 130 comprises a wiper 131 and a second sliding portion 132. The wiper 131 is disposed on the wiper holder 130. The second sliding portion 132 is disposed under the wiper holder 130 and slides in the second through groove 122 of the base 120, as shown in FIG. 6B. Specifically, as shown in FIG. 5B, the second sliding portion 132 of each wiper holder 130 simultaneously slides in the second through groove 122 of the base 120 and fourth through groove 113 of the support structure 110.

Figure 7B:
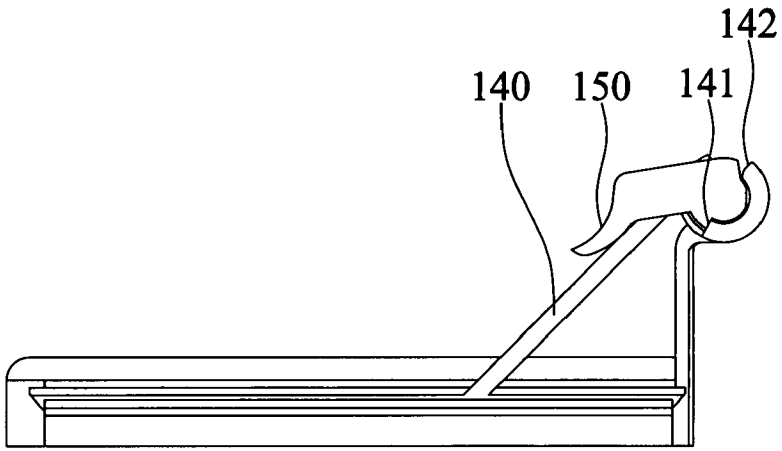
FIG. 7B is a schematic side view according to FIG. 7A.
Figure 7A:
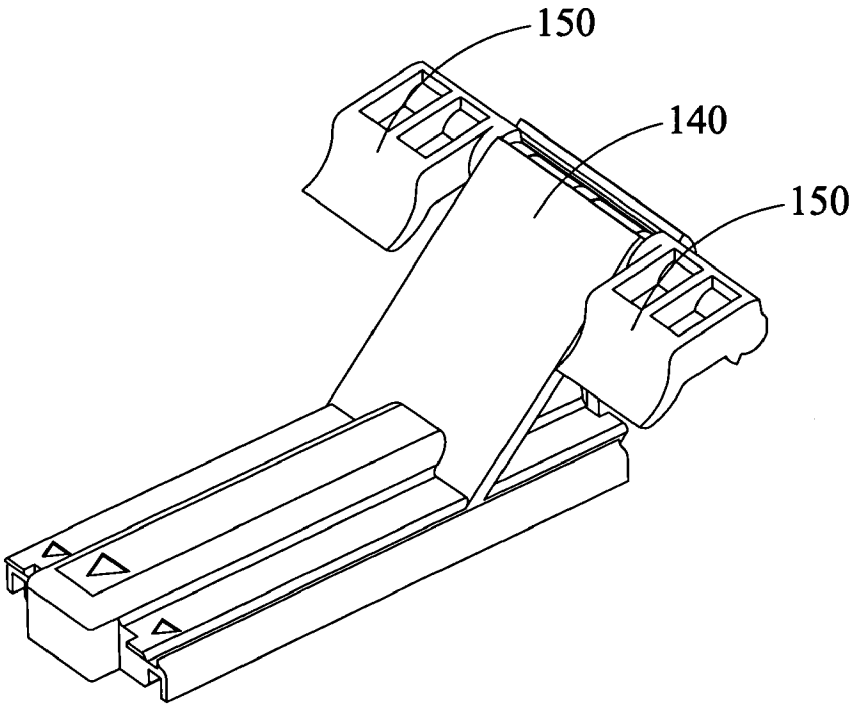
FIG. 7A is a schematic perspective view of the rotating member of the ink removal device of the invention.

Referring to FIG. 7A and FIG. 7B, the rotating member 140 is disposed on the base 120 and the scrapers 150 are rotatably disposed on the rotating member 140. FIG. 7A and FIG. 4A are from the same angle of view. The rotating member 140 comprises a first retardant portion 141 and a second retardant portion 142. Each scraper 150 rotates between the first retardant portion 141 and the second retardant portion 142. Specifically, each scraper 150 rotates between a first position (FIG. 8A) and a second position (FIG. 8B). When in the first position, the scraper 150 abuts the first retardant portion 141. In another aspect, the scraper 150 abuts the second retardant portion 142 when in the second position. Each wiper 131 moves relative to each scraper 150 by means of the second sliding portion 132 of each wiper holder 130 sliding in the second through groove 122 of the base 120.

The positioning column 160 is disposed on the base 120 and comprises a positioning portion 161 to engage and position the cartridge carrier 32. Additionally, the positioning column 160 comprises a third sliding portion 162. The third sliding portion 162 slides in the third through groove 112 of the support structure 110 by movement of the cartridge carrier 32.

As shown in FIGS. 4A, 4B and 5A, the ink removal device 100 further comprises two resilient elements 170, such as two springs. The resilient elements 170 are respectively connected to the support structure 110 and first sliding portions 121 of the base 120, providing resilience to the base 120.

Figure 8A:
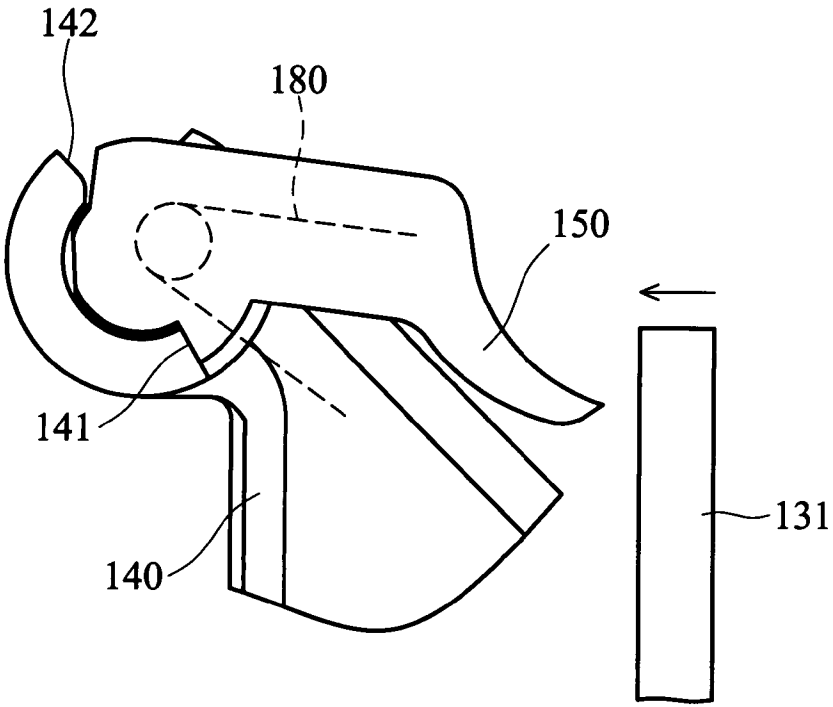
FIG. 8A is a partial side view of the scraper of the ink removal device of the invention in a first position.
Figure 8B:
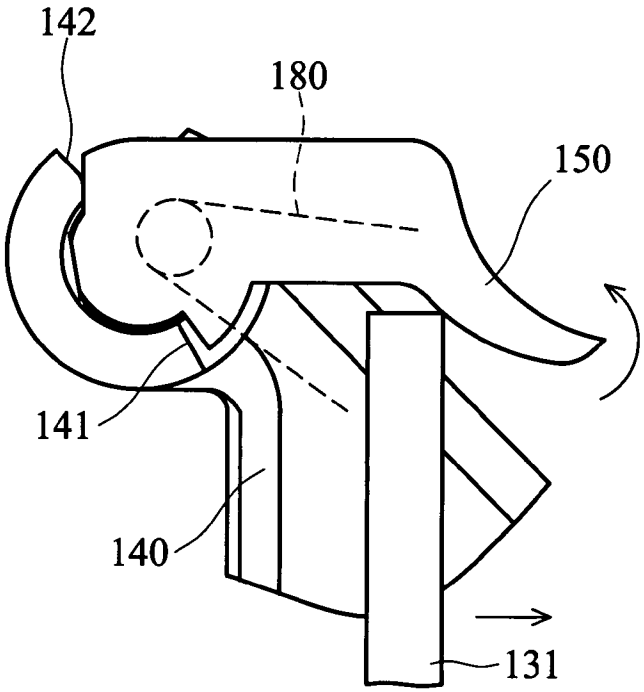
FIG. 8B is a partial side view of the scraper of the ink removal device of an embodiment of the invention in a second position.
Figure 9A:
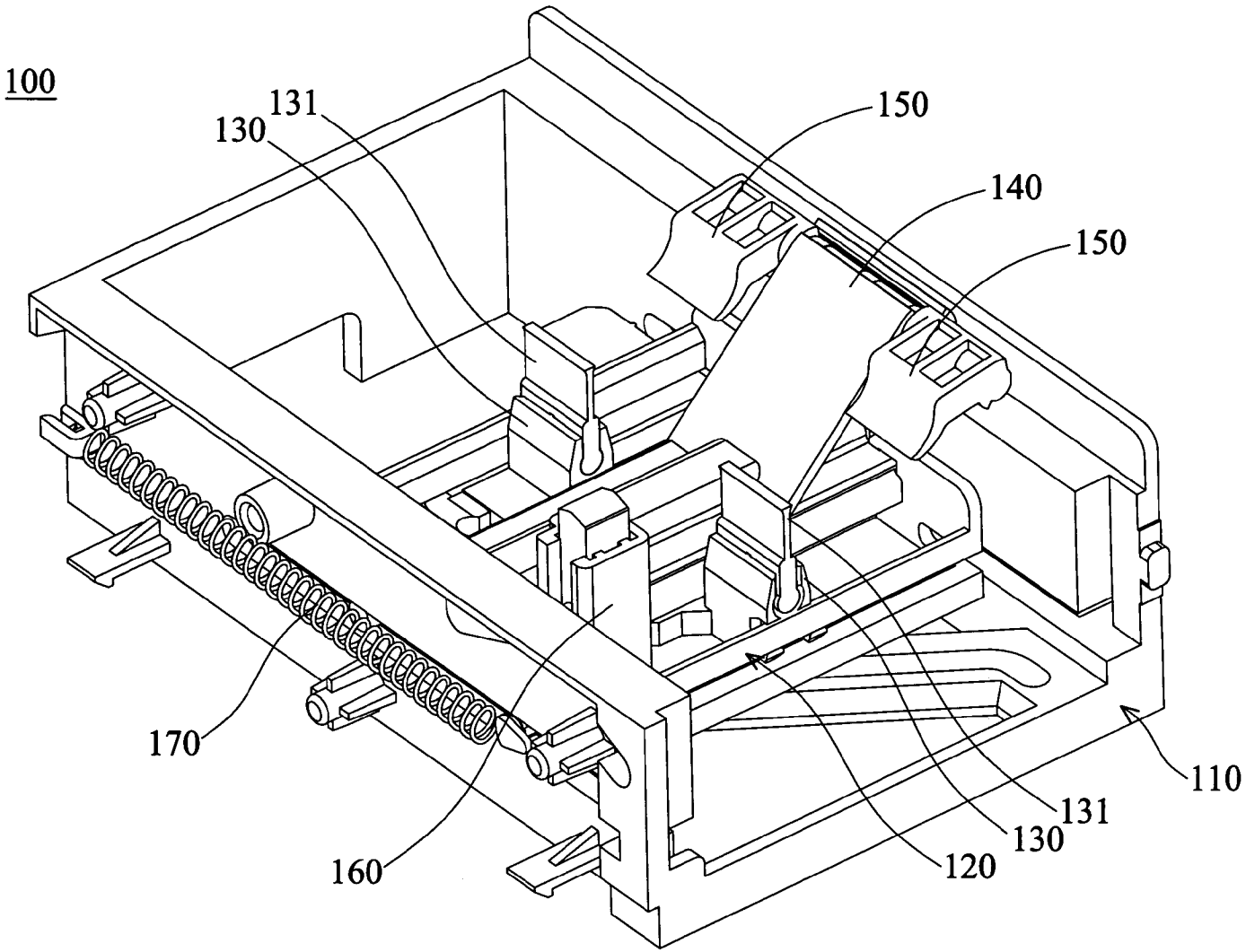
FIG. 9A is a schematic view showing operation of the ink removal device of an embodiment of the invention according to FIG. 4A.
Figure 9B:
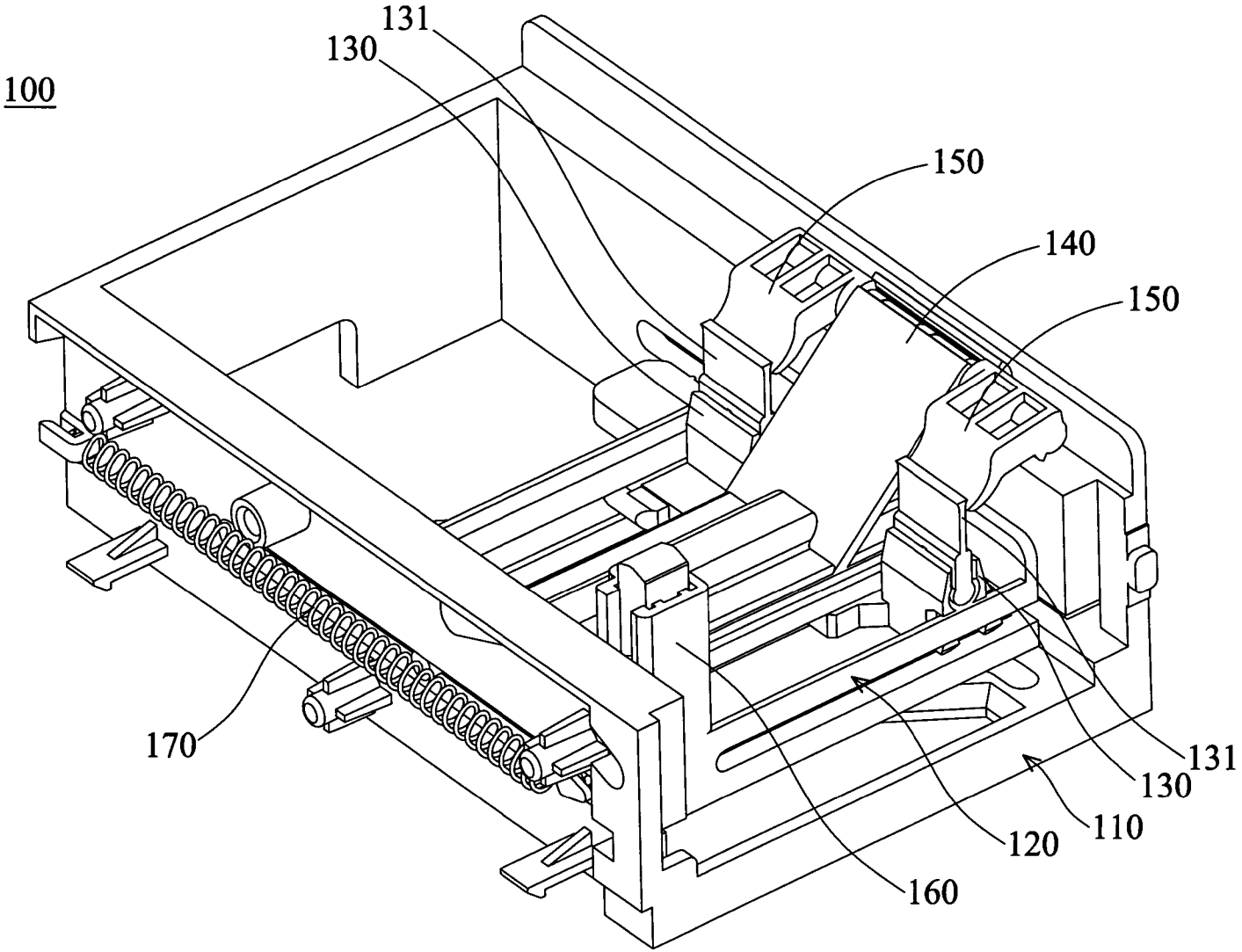
FIG. 9B is a schematic view showing operation of the ink removal device of an embodiment of the invention according to FIG. 9A.
Figure 9C:
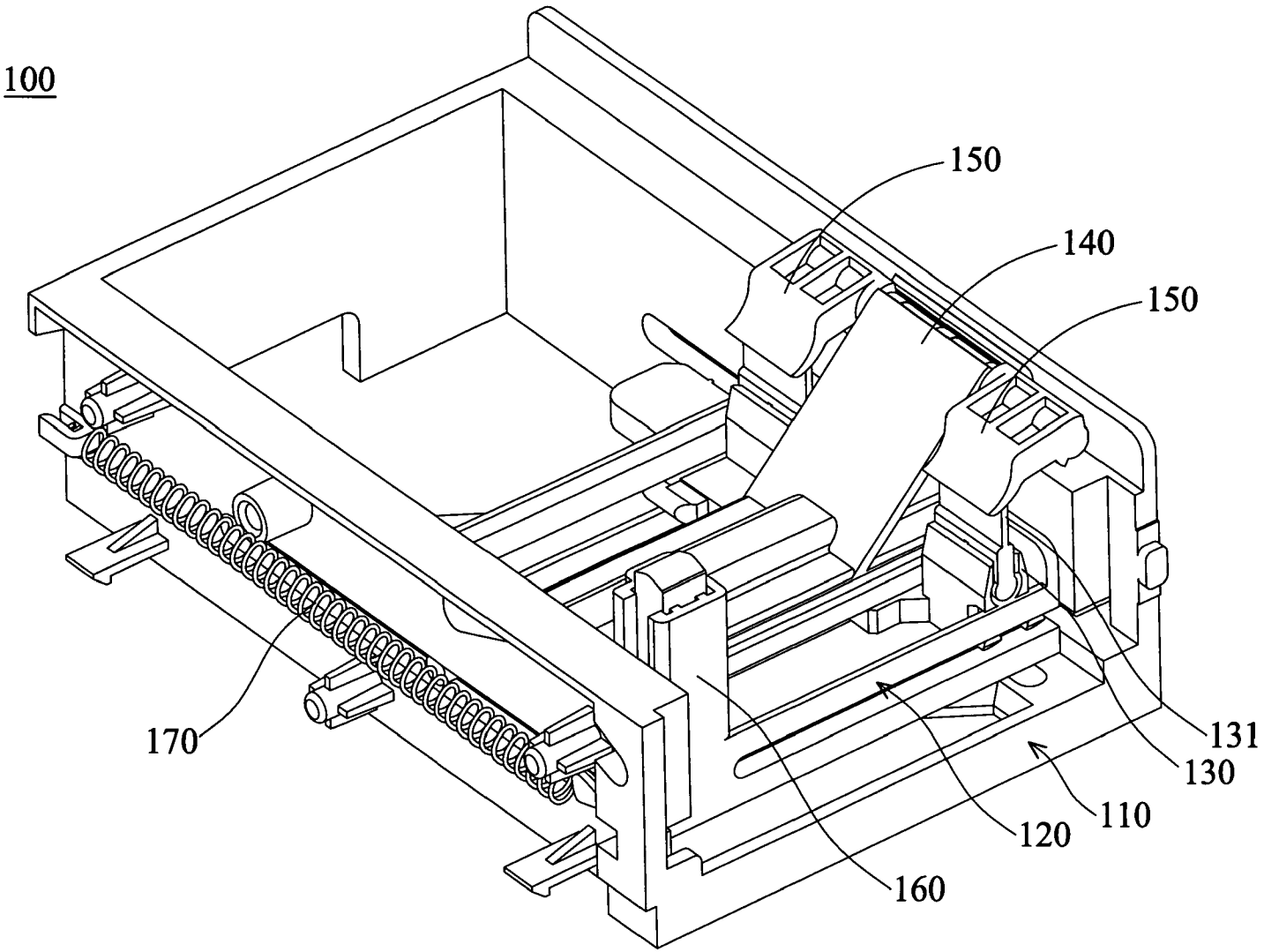
FIG. 9C is a schematic view showing operation of the ink removal device of an embodiment of the invention according to FIG. 9B.
Figure 9D:
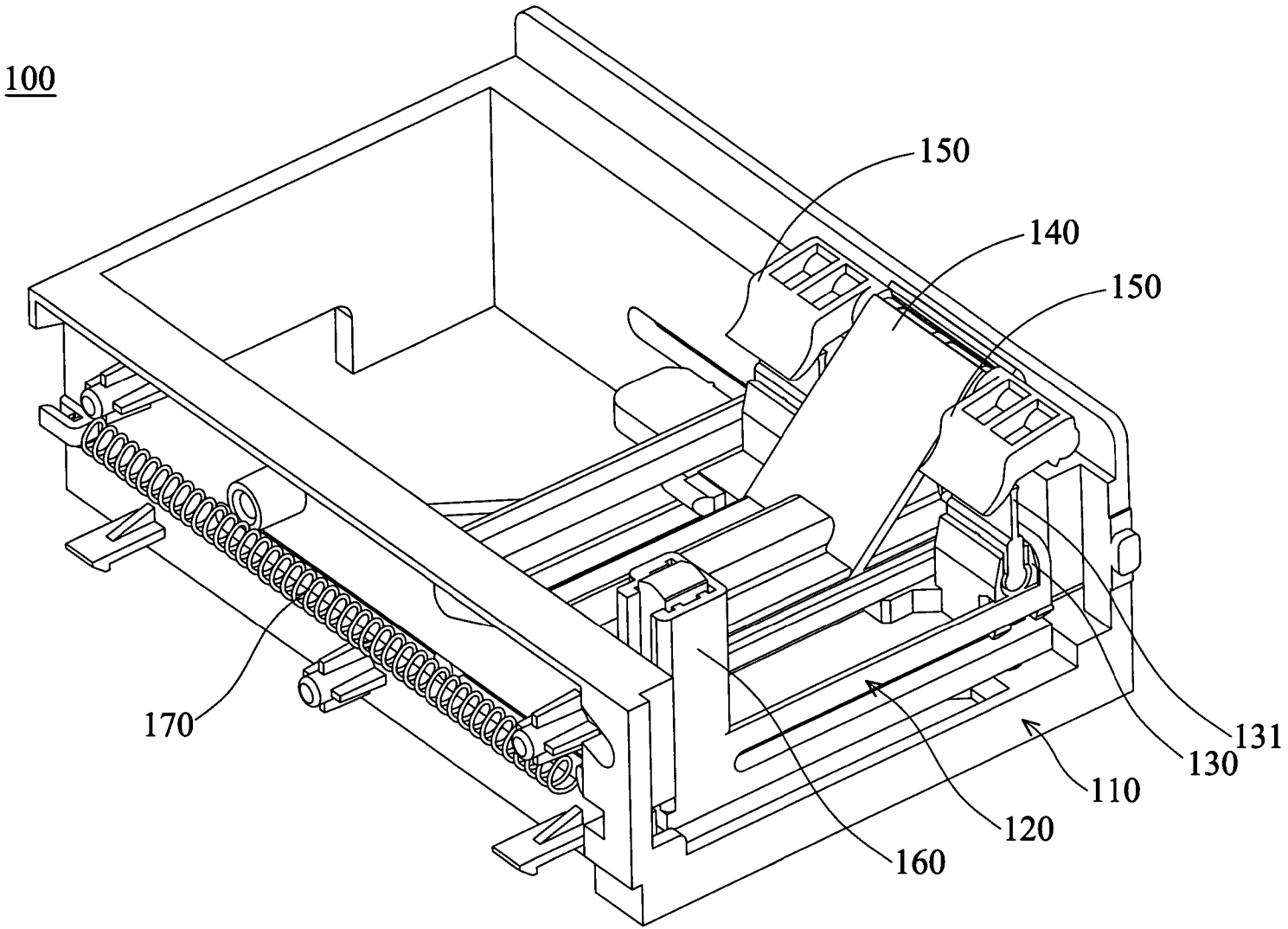
FIG. 9D is a schematic view showing operation of the ink removal device of an embodiment of the invention according to FIG. 9C.

As shown in FIG. 8A and FIG. 8B, the ink removal device 100 can selectively comprise two torsion springs 180. Each torsion spring 180 is disposed between the rotating member 140 and the scraper 150, providing resilience to the scraper 150.

In this embodiment, the wiper 131 is rubber and the scraper 150 is plastic or metal.

The following description is directed to operation of the ink removal device 100.

As shown in FIG. 3 and FIG. 4A, the first sliding portions 121 of the base 120 are originally held at the left part of the support structure 110 by resilience of the resilient elements 170. When the cartridge carrier 32 carrying the cartridge 31 moves rightward onto the maintenance portion 34 (ink removal device 100), the positioning portion 161 of the positioning column 160 engages the cartridge carrier 32. The cartridge carrier 32 continues to move rightward. At this point, the third sliding portion 162 of the positioning column 160 slides in the third through groove 112 of the support structure 110 due to movement of the cartridge carrier 32, and the base 120 moves on the support structure 110 by means of the positioning column 160 carried by the cartridge carrier 32. Specifically, the first sliding portions 121 of the base 120 respectively slide in the first through grooves 111 of the support structure 110, and the second sliding portion 132 of each wiper holder 130 simultaneously slides in each second through groove 122 of the base 120 and each fourth through groove 113 of the support structure 110 due to rightward movement of the base 120. As shown in FIG. 5B, the horizontal included angle θ exists between each fourth through groove 113 and each second through groove 122. Each wiper holder 130 and wiper 131 move relative to each scraper 150 by guidance from each fourth through groove 113 and second through groove 122. Specifically, since the positioning portion 161 of the positioning column 160 engages the cartridge carrier 32, the cartridge 31 (print head 33) remains above the base 120 during rightward movement of the cartridge carrier 32. The wipers 131 first slide on the print head 33 to remove residual ink therefrom. The wipers 131 then slide to the scrapers 150. The residual ink on the wipers 131 can thus be removed by the scrapers 150, as shown in FIGS. 8A, 8B, 9A, 9B, 9C and 9D. FIGS. 4A, 9A, 9B, 9C and 9D show the same angle of view. Moreover, as shown in FIG. 8B, when removing the residual ink from the wipers 131, the scrapers 150 are lifted by the wipers 131 and can only rotate to the second position. The second retardant portion 142 limits rotation of the scrapers 150.

In another aspect, when the cartridge carrier 32 carrying the cartridge 31 moves leftward from the maintenance portion 34, the wipers 131 are slidably separated from the scrapers 150, as shown in FIG. 8A. The scrapers 150 return to the first position due to gravity or the resilience provided by the torsion springs 180. Similarly, the first retardant portion 141 limits rotation of the scrapers 150. The third sliding portion 162 of the positioning column 160 then slides leftward in the third through groove 112 of the support structure 110 and the base 120 slides leftward on the support structure 110 by means of the positioning column 160 carried by the cartridge carrier 32. At this point, the first sliding portions 121 of the base 120 respectively reverse in the first through grooves 111 of the support structure 110 and the second sliding portions 132 of the wiper holder 130 respectively reverse in the second through grooves 122 of the base 120 and fourth through grooves 113 of the support structure 110 due to leftward movement of the base 120. Similarly, the wipers 131 slide on the print head 33 to again remove the residual ink therefrom. Specifically, when the third sliding portion 162 of the positioning column 160 slides to the horizontal portion of the third through groove 112, the resilience provided by the resilient elements 170 connected to the support structure 110 and first sliding portions 121 of the base 120 allows the base 120 to move leftward or return more smoothly.

Accordingly, whenever the inkjet printer 3 performs maintenance for the print head 33, the cartridge carrier 32 carrying the cartridge 31 is moved rightward onto the maintenance portion 34 (ink removal device 100) and the residual ink on the print head 33 and wipers 131 can be removed simultaneously.

Moreover, the ink removal device 100 is not limited to comprising rotatable scrapers 150 and wipers 131 fixed on the wiper holders 130. Namely, the scrapers 150 may be fixed on the rotating member 140 and the wipers 131 may be rotatably disposed on the wiper holders 130. Accordingly, when the wiper holders 130 move and encounter the scrapers 150, the wipers 131 rotate due to obstruction created by the scrapers 150 and the residual ink on the wipers 131 can then be removed by the scrapers 150.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An ink removal device for an inkjet printer with a cartridge carrier and a print head, comprising:

a base;

a wiper holder movably disposed on the base and comprising a wiper disposed thereon to remove residual ink from the print head;

a rotating member disposed on the base, comprising a first retardant portion and a second retardant portion; and a scraper rotatably disposed on the rotating member and rotating between a first position when abutting the first retardant portion and a second position when abutting the second retardant portion, to remove residual ink from the wiper, wherein when the scraper located at the second position and without receiving non-gravity force, the scraper moves away from the second position and toward the first position solely by the weight of the scraper, and the wiper moves relative to the scraper by means of the wiper holder sliding on the base.

2. The ink removal device as claimed in claim 1, further comprising a positioning column disposed on the base and comprising a positioning portion to engage and position the cartridge carrier.

3. The ink removal device as claimed in claim 1, further comprising a torsion spring disposed between the rotating member and the scraper.

4. The ink removal device as claimed in claim 1, wherein the wiper is rubber.

5. The ink removal device as claimed in claim 1, wherein the scraper is plastic or metal.

6. An ink removal device for an inkjet printer with a cartridge carrier and a print head, comprising:

a base, comprising a first retardant portion and a second retardant portion;

a wiper movably disposed on the base to remove residual ink from the print head; and a scraper rotatably disposed on the base and rotating between a first position when abutting the first retardant portion and a second position when abutting the second retardant portion, to remove residual ink from the wiper, wherein when the scraper located at the second position and without receiving non-gravity force, the scraper moves away from the second position and toward the first position solely by the weight of the scraper, and the wiper moves on the base and relative to the scraper such that the residual ink thereon is removed by the scraper.

7. The ink removal device as claimed in claim 6, further comprising a positioning column disposed on the base and comprising a positioning portion to engage and position the cartridge carrier.

8. The ink removal device as claimed in claim 6, further comprising a torsion spring disposed between the base and the scraper.

9. The ink removal device as claimed in claim 6, wherein the wiper is rubber.

10. The ink removal device as claimed in claim 6, wherein the scraper is plastic or metal.

11. An ink removal device for an inkjet printer with a cartridge carrier and a print head, comprising:

a base, comprising a first retardant portion and a second retardant portion;

a wiper holder movably disposed on the base and comprising a wiper rotatably disposed thereon to remove residual ink from the print head; and a scraper disposed on the base and rotating between a first position when abutting the first retardant portion and a second position when abutting the second retardant portion, to remove residual ink from the wiper, wherein when the scraper located at the second position and without receiving non-gravity force, the scraper moves away from the second position and toward the first position solely by the weight of the scraper, and the wiper moves relative to the scraper by means of the wiper holder sliding on the base, such that the residual ink on the wiper is removed by the scraper.

12. The ink removal device as claimed in claim 11, further comprising a positioning column disposed on the base and comprising a positioning portion to engage and position the cartridge carrier.

13. The ink removal device as claimed in claim 11, wherein the wiper is rubber.

14. The ink removal device as claimed in claim 11, wherein the scraper is plastic or metal.

* * * * *